US010976112B2

(12) United States Patent
Kawabata et al.

(10) Patent No.: US 10,976,112 B2
(45) Date of Patent: Apr. 13, 2021

(54) HEAT PIPE

(71) Applicant: FURUKAWA ELECTRIC CO., LTD., Tokyo (JP)

(72) Inventors: Kenya Kawabata, Tokyo (JP); Yoshikatsu Inagaki, Tokyo (JP)

(73) Assignee: FURUKAWA ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/677,160

(22) Filed: Nov. 7, 2019

(65) Prior Publication Data

US 2020/0149823 A1 May 14, 2020

(30) Foreign Application Priority Data

Nov. 9, 2018 (JP) ..... JP2018-211126

(51) Int. Cl.
*F28D 15/04* (2006.01)
*F28F 13/00* (2006.01)
*B22F 5/00* (2006.01)

(52) U.S. Cl.
CPC ..... *F28D 15/046* (2013.01); *F28F 13/003* (2013.01); *B22F 5/00* (2013.01); *F28F 2255/18* (2013.01)

(58) Field of Classification Search
CPC ..... F28D 15/02; F28D 15/04; F28D 15/046; F28D 15/0275; F28D 2015/0225;
(Continued)

(56) References Cited

U.S. PATENT DOCUMENTS 4,274,479 A * 6/1981 Eastman ..... F28D 15/046 122/366
4,489,777 A * 12/1984 Del Bagno ..... F28D 15/046 165/104.26

(Continued)

FOREIGN PATENT DOCUMENTS

FR 2935787 A1 * 3/2010 ..... F28D 15/0233
JP S5184449 A * 7/1976

(Continued)

OTHER PUBLICATIONS

Design Considerations When Using Heat Pipes—Meyer (Aug. 2016) (Year: 2016).*

(Continued)

*Primary Examiner* — Len Tran
*Assistant Examiner* — Jenna M Hopkins
(74) *Attorney, Agent, or Firm* — Birch, Stewart, Kolasch & Birch, LLP

(57) ABSTRACT

The present disclosure is related to providing a heat pipe that can exhibit excellent heat transport properties under tougher use conditions such as a situation in which an amount of heat generation by electronic components further increases. A heat pipe including: a container having a tubular shape in which an end surface of one end part and an end surface of another end part are sealed, the container including an inner wall surface in which a groove part is formed; a sintered body layer provided on the inner wall surface of the container, the sintered body layer being formed by sintering a powder; and a working fluid sealed in a hollow part of the container, wherein: the sintered body layer includes a first sintered part located in an evaporation part of the heat pipe, and a second sintered part located in a heat insulation part between the evaporation part and a condensation part of the heat pipe, the second sintered part being continuous with the first sintered part, and a capillary force of the first sintered
(Continued)

part is larger than a capillary force of the second sintered part.

12 Claims, 5 Drawing Sheets

(58) Field of Classification Search
CPC ..... F28D 2021/0029; F28F 13/003; F28F 13/18–187
See application file for complete search history.

(56) References Cited

U.S. PATENT DOCUMENTS 6,362,415 B1 * 3/2002 Snyder ..... H01J 35/02 174/15.1
6,460,612 B1 * 10/2002 Sehmbey ..... F28D 15/046 165/104.26
7,086,454 B1 * 8/2006 Hsu ..... F28D 15/046 165/104.26
7,316,264 B2 * 1/2008 Lai ..... F28D 15/046 165/104.21
7,520,315 B2 * 4/2009 Hou ..... F28D 15/0233 165/104.26
7,594,537 B2 * 9/2009 Hou ..... F28D 15/0233 165/104.26
7,828,046 B2 * 11/2010 Huang ..... B22F 5/106 165/104.26
9,293,072 B1 * 3/2016 Richert ..... G09F 19/00
9,618,275 B1 * 4/2017 Anderson ..... F28D 15/046
9,752,832 B2 * 9/2017 Kare ..... F28D 15/04
2005/0077030 A1 * 4/2005 Wong ..... F28D 15/043 165/104.26
2006/0162906 A1 * 7/2006 Hong ..... F28D 15/046 165/104.26
2006/0283574 A1 * 12/2006 Huang ..... F28D 15/046 165/104.26
2007/0084587 A1 * 4/2007 Huang ..... B22F 5/106 165/104.26
2007/0107878 A1 * 5/2007 Hou ..... F28D 15/025 165/104.26
2007/0193723 A1 * 8/2007 Hou ..... F28D 15/0233 165/104.26
2007/0240858 A1 * 10/2007 Hou ..... F28D 15/046 165/104.26
2007/0284088 A1 * 12/2007 Chun ..... F28D 15/046 165/104.21
2007/0295484 A1 * 12/2007 Tsai ..... C09K 5/04 165/104.21
2008/0099186 A1 * 5/2008 Yu ..... F28D 15/0241 165/104.11
2009/0020269 A1 * 1/2009 Chang ..... F28D 15/046 165/104.26
2009/0084526 A1 * 4/2009 Chang ..... F28D 15/046 165/104.26
2009/0166014 A1 * 7/2009 Chang ..... F28D 15/02 165/133
2010/0243213 A1 * 9/2010 Obara ..... C09K 5/04 165/104.26
2010/0263833 A1 * 10/2010 Lee ..... F28D 15/046 165/104.26
2010/0263835 A1 * 10/2010 Wang ..... F28D 15/0266 165/104.26
2010/0276122 A1 * 11/2010 Daly ..... B01D 5/0009 165/111
2011/0168222 A1 * 7/2011 Lee ..... H01G 9/21 136/205
2012/0175084 A1 * 7/2012 Horng ..... F28D 15/02 165/104.26
2012/0211200 A1 * 8/2012 Humburg ..... B60N 3/16 165/104.19
2012/0325440 A1 * 12/2012 Honmura ..... F28F 21/084 165/104.26
2013/0037242 A1 * 2/2013 Chen ..... F28D 15/0233 165/104.26
2013/0043004 A1 * 2/2013 Wang ..... F28D 15/0283 165/104.21
2013/0092354 A1 * 4/2013 Semenov ..... F28D 15/04 165/104.26
2013/0160977 A1 * 6/2013 Fan ..... F28D 15/04 165/104.26
2013/0174966 A1 * 7/2013 He ..... B22F 7/002 156/89.11
2013/0186600 A1 * 7/2013 Sun ..... F28D 15/0233 165/104.26
2013/0213611 A1 * 8/2013 Wu ..... F28D 15/0233 165/104.26
2013/0299136 A1 * 11/2013 Bilski ..... F28F 13/14 165/104.26
2014/0054014 A1 * 2/2014 Dai ..... B22F 7/08 165/104.26
2014/0166244 A1 * 6/2014 Dai ..... F28D 15/046 165/104.26
2014/0166246 A1 * 6/2014 Dai ..... F28D 15/046 165/104.26
2014/0174086 A1 * 6/2014 Kare ..... F01K 11/00 60/670
2015/0060021 A1 * 3/2015 Chauhan ..... F28D 15/046 165/104.26
2015/0090428 A1 * 4/2015 Chauhan ..... F28D 15/046 165/104.26
2015/0198380 A1 * 7/2015 Haj-Hariri ..... B64G 1/50 62/3.2
2015/0204617 A1 * 7/2015 Thanhlong ..... F28D 15/046 165/104.26
2016/0014931 A1 1/2016 Hamakawa
2016/0018165 A1 * 1/2016 Ahamed ..... F28D 15/0233 165/104.26
2016/0018166 A1 * 1/2016 Ahamed ..... F28D 15/04 165/104.26
2016/0131436 A1 * 5/2016 Hsieh ..... F28D 15/04 165/104.26
2016/0153722 A1 * 6/2016 Huang ..... F28D 15/0233 165/104.26
2016/0187069 A1 * 6/2016 Sun ..... F28D 15/043 165/104.26
2016/0216042 A1 * 7/2016 Bozorgi ..... F28D 15/0233
2017/0102188 A1 * 4/2017 Anderl ..... F28D 15/06
2017/0122673 A1 * 5/2017 Chin ..... B23P 15/26
2017/0160018 A1 * 6/2017 Tseng ..... F28D 15/046
2017/0234624 A1 * 8/2017 Cai ..... F28D 15/02 165/104.26
2017/0338167 A1 * 11/2017 Bozorgi ..... F28F 21/086
2018/0106552 A1 * 4/2018 Lin ..... F28D 15/0266
2018/0209746 A1 * 7/2018 Tsai ..... F28D 15/043
2018/0306523 A1 * 10/2018 Sasaki ..... F28D 15/0233
2018/0313611 A1 * 11/2018 Sasaki ..... H01L 23/427
2018/0320985 A1 * 11/2018 Salim Shirazy ..... F28D 15/046
2018/0374737 A1 * 12/2018 Margavio ..... H01L 21/67103
2019/0339022 A1 * 11/2019 Tseng ..... F28D 15/0266
2019/0342986 A1 * 11/2019 Chen ..... F28D 15/0275
2020/0041215 A1 * 2/2020 Inagaki ..... F28D 15/02

FOREIGN PATENT DOCUMENTS

JP 2002-318085 A 10/2002
JP 2005114179 A * 4/2005
JP 2006125683 A * 5/2006 ..... F28D 15/0266
JP 2017-72340 A 4/2017
JP 2017-83138 A 5/2017
JP 6302116 B1 * 3/2018 ..... F28D 15/04
TW I294512 B 3/2008
TW I295366 B 4/2008
TW I320093 B 2/2010
WO WO-0188456 A2 * 11/2001 ..... F28D 15/043
WO WO 2014/157147 A1 10/2014

(56) References Cited

FOREIGN PATENT DOCUMENTS

| | | | | |
|---|---|---|---|---|
| WO | WO-2015105519 A1 * | 7/2015 | ..... | F28D 15/0266 |
| WO | WO-2019016873 A1 * | 1/2019 | ..... | F28D 15/02 |

OTHER PUBLICATIONS

Effect of Variation in Length of the Conventional Heat Pipe—SEO (Jul. 2017) (Year: 2017).*
Effects of Particle Size and Particle Size Distribution—LIN (Sep. 2009) (Year: 2009).*
Experimental Analysis of Condenser Length—Anjankar (Mar. 2012) (Year: 2012).*
Notice of Allowance for Japanese Application No. 2018-211126 dated Jun. 24, 2019.
Notification of Reasons for refusal for Japanese Application No. 2018-211126 dated Mar. 4, 2019.
Office Action dated Jul. 10, 2020 in corresponding Taiwanese Patent Application No. 108140617, with English translation.

* cited by examiner 1
10
12
13
17
13
B
B
19
L2
16
18
18
L4
14
L3
100
L1
15
A
A
11

1
10
14
16
19
17
13
16
19
13

1
10
14
15
11
17
13
15
11
13

HEAT PIPE

CROSS REFERENCE TO RELATED APPLICATIONS

This application claims the benefit of Japanese Patent Application No. 2018-211126, filed Nov. 9, 2018, which is hereby incorporated by reference in its entirety.

BACKGROUND

Technical Field

The present disclosure relates to a heat pipe that has a favorable maximum heat transport amount, further has a small thermal resistance and exhibits excellent heat transport properties.

Background

In electronic components such as semiconductor devices mounted in electric and electronic apparatuses such as desktop personal computers and servers, amounts of heat generation are increased because of, e.g., enhancement in functionality, and cooling thereof has become further crucial. As a cooling method for the electronic components, heat pipes are sometimes used.

Therefore, as a cooling member for an electronic component such as a semiconductor device with an increased amount of heat generation, for example, a heat pipe including a pipe member including a heating element mounted on an outer peripheral surface thereof and a porous sintered body disposed inside the pipe member, the sintered body receiving heat from the heating element and releasing the heat, in which the sintered body includes a base that is in contact with a portion of an inner peripheral surface thereof, the portion corresponding to the heating element mounted on the outer peripheral surface of the pipe member, has been proposed (Japanese Patent Application Laid-Open No. 2002-318085).

In Japanese Patent Application Laid-Open No. 2002-318085, cooling performance of the heat pipe is enhanced by using a sintered metal of a metal having good heat conductivity for a sintered body to improve boiling performance and liquid suction performance on the evaporation part side of the heat pipe and thereby obtaining the sintered body with improved cooling liquid suction performance on the condensation part side of the heat pipe. However, the heat pipe in Japanese Patent Application Laid-Open No. 2002-318085 has a problem in that no sufficient heat dissipation properties can be obtained under tougher use conditions such as a situation in which an amount of heat generation by electronic components further increases.

In addition, the heat pipes are sometimes installed in cold environments. In this case, in particular, when a heat pipe is not in operation, a working fluid in a liquid phase may locally be pooled in a container. In cold regions, a working fluid in a liquid phase pooled in a container is frozen and the volume of the working fluid thus expands, which leads to a problem in that a frequency of deformation and destruction of the container further increases. In addition, a non-freezing solution is used in order to prevent freezing of the working fluid or a wall thickness of the container is made larger in order to prevent deformation and destruction of the container due to the freezing of the working fluid, which leads to a problem in that heat transport properties of the heat pipe deteriorate.

SUMMARY

The present disclosure is related to providing a heat pipe that can exhibit excellent heat transport properties under tougher use conditions such as a situation in which an amount of heat generation by electronic components further increases.

An aspect of the present disclosure provides:

[1] A heat pipe including:

a container having a tubular shape in which an end surface of one end part and an end surface of another end part are sealed, the container including an inner wall surface in which a groove part is formed;

a sintered body layer provided on the inner wall surface of the container, the sintered body layer being formed by sintering a powder; and a working fluid sealed in a hollow part of the container, wherein:

the sintered body layer includes a first sintered part located in an evaporation part of the heat pipe, and a second sintered part located in a heat insulation part between the evaporation part and a condensation part of the heat pipe, the second sintered part being continuous with the first sintered part, and a capillary force of the first sintered part is larger than a capillary force of the second sintered part.

[2] The heat pipe according to [1], wherein the sintered body layer is provided in the one end part and a central part in the longitudinal direction of the container and is not provided in the other end part.

[3] The heat pipe according to [1], wherein the sintered body layer is provided in a central part in the longitudinal direction of the container and is not provided in the one end part and the other end part.

[4] The heat pipe according to any one of [1] to [3], wherein the sintered body layer is not provided in the condensation part and the groove part is exposed in the condensation part.

[5] The heat pipe according to any one of [1] to [4], wherein the sintered body layer is a sintered body of a metallic powder.

[6] The heat pipe according to [4], wherein an average primary particle diameter of a first metallic powder that is a raw material of the first sintered part is smaller than an average primary particle diameter of a second metallic powder that is a raw material of the second sintered part.

[7] The heat pipe according to any one of [1] to [6], wherein the capillary force of the first sintered part is larger than the capillary force of a portion of the groove part, the portion being located in the evaporation part.

[8] The heat pipe according to any one of [1] to [7], wherein the capillary force of the second sintered part is larger than the capillary force of a portion of the groove part, the portion being located in the heat insulation part.

[9] The heat pipe according to any one of [1] to [8], wherein a porosity of the second sintered part in a portion of the groove part, the portion being located in the heat insulation part is larger than a porosity of the first sintered part in a portion of the groove part, the portion being located in the evaporation part.

[10] The heat pipe according to any one of [1] to [9], wherein in a cross-section perpendicular to the longitudinal direction of the container, an uneven part is formed in a surface of the first sintered part.

[11] The heat pipe according to any one of [1] to [10], wherein an average thickness of the first sintered part is smaller than an average thickness of the second sintered part.

[12] The heat pipe according to any one of [1] to [10], wherein an average thickness of the first sintered part is larger than an average thickness of the second sintered part.

[13] The heat pipe according to [6], wherein a ratio of the average primary particle diameter of the second metallic powder to the average primary particle diameter of the first metallic powder is 1.3 to 2.0.

In the aspect of [1] above, the sintered body layer is provided on portions of the inner wall surface of the container, the portions corresponding to the evaporation part and the heat insulation part. In addition, the inner wall surface of the container includes a portion in which the groove part is exposed and a portion covered by the sintered body layer. A boundary part between the first sintered part and the second sintered part is formed in the sintered body layer including the first sintered part and the second sintered part. In addition, the sintered body layer functions as a wick structure that generates a capillary force. Since the capillary force of the first sintered part is larger than the capillary force of the second sintered part, a flow path resistance inside the second sintered part against the working fluid in a liquid phase is smaller than a flow path resistance inside the first sintered part against the working fluid in the liquid phase.

In addition, in the aspect of [1] above, where a portion of the container provided with the sintered body layer, the portion corresponding to the first sintered part, is made to function as an evaporation part (heat receiving part), a portion of the container, the portion corresponding to the second sintered part, is made to function as a heat insulation part and a portion not provided with the sintered body layer is made to function as a condensation part (heat dissipation part), the working fluid in the liquid phase that has been refluxed from the condensation part to the evaporation part provided with the first sintered part smoothly diffuses inside the first sintered part toward the heat insulation part provided with the second sintered part, by means of a capillary action of the first sintered part whose capillary force is relatively large. The working fluid in the liquid phase that has diffused inside the first sintered part receives heat from a cooled target and phase-changes from the liquid phase to a gas phase. The working fluid that has phase-changed from the liquid phase to the gas phase flows from the evaporation part to the condensation part and releases latent heat at the condensation part. The working fluid that has released the latent heat and phase-changed from the gas phase to the liquid phase is refluxed from the condensation part of the container to the evaporation part provided with the first sintered part, by a capillary force of the groove part and the capillary force of the second sintered part in the heat insulation part. Since the second sintered part is provided in the heat insulation part, in the heat insulation part, the capillary force of the groove part in the inner wall surface of the container and the capillary force of the second sintered part are generated.

According to the aspect of the present disclosure, since the flow path resistance inside the second sintered part is smaller than the flow path resistance inside the first sintered part, the working fluid in the liquid phase can smoothly be refluxed from the condensation part to the evaporation part. In addition, since in the heat insulation part, the capillary force of the groove part in the inner wall surface of the container and the capillary force of the second sintered part are generated, it is possible to prevent the reflux of the working fluid in the liquid phase from the condensation part toward the evaporation part from being hindered by the working fluid in the gas phase that flows from the evaporation part toward the condensation part. Furthermore, since the capillary force of the first sintered part located in the evaporation part is larger than the capillary force of the second sintered part located in the heat insulation part, the working fluid in the liquid phase that has been refluxed to the evaporation part can smoothly diffuse inside the first sintered part toward the heat insulation part provided with the second sintered part, and as a result, the working fluid in the liquid phase diffuses over the whole first sintered part. Therefore, it is possible to prevent drying-out of the working fluid in the liquid phase in the evaporation part. According to the above, a heat pipe according to the present disclosure has excellent heat transport properties. Therefore, a heat pipe according to the present disclosure can exhibit excellent heat transport properties even under tougher use conditions such as a situation in which an amount of heat generation by an electronic component further increases.

In addition, according to the aspect of the present disclosure, when the heat pipe is not in operation, the working fluid in the liquid phase that has been refluxed to the first sintered part smoothly diffuses inside the first sintered part without liquid-pooling in the first sintered part. Therefore, even when the heat pipe is not in operation, the working fluid in the liquid phase can be prevented from liquid-pooling in the evaporation part of the container, and thus, freezing of the working fluid in the liquid phase is inhibited. According to the above, the heat pipe can exhibit excellent heat transport properties even under tougher use conditions such as the heat pipe being installed in a cold environment. In addition, even if the working fluid in the liquid phase freezes, the working fluid in the liquid phase is prevented from locally liquid-pooing and local expansion in volume of the working fluid is alleviated, enabling prevention of deformation of the container.

In addition, according to the aspect of the present disclosure, there is no need to use a non-freezing solution as the working fluid and it is possible to use a container whose thickness is small and thus it is possible to exhibit excellent heat transport properties.

In addition, according to the aspect of the present disclosure, since the sintered body layer is a sintered body of a metallic powder, that is, each of the first sintered part and the second sintered part is formed of a sintered body of a metallic powder, it is possible to provide an excellent force of bonding between the first sintered part and the second sintered part. In addition, as a result of each of the first sintered part and the second sintered part being formed of a sintered body of a metallic powder, a process of forming the sintered body layer is simplified and efficiency of manufacture of the sintered body layer is enhanced in comparison with a case where the first sintered part and the second sintered part are formed of different materials (for example, one sintered part is formed of a metallic mesh and the other sintered part is formed of a sintered body of a metallic powder).

In addition, according to the aspect of the present disclosure, since the capillary force of the second sintered part is larger than the capillary force of the portion of the groove part, the portion being located in the heat insulation part, the reflux of the working fluid in the liquid phase from the condensation part toward the evaporation part can reliably be prevented from being hindered by the working fluid in the gas phase, which flows from the evaporation part toward the condensation part. Therefore, a heat pipe according to the present disclosure can exhibit more excellent heat transport properties.

In addition, according to the aspect of the present disclosure, since the porosity of the second sintered part inside the portion of the groove part, the portion being located in the heat insulation part, is larger than the porosity of the first sintered part inside the portion of the groove part, the portion being located in the evaporation part, heat conductivity between the container and the first sintered part is enhanced in the evaporation part while enabling the working fluid in the liquid phase to be more smoothly refluxed inside the second sintered part located in the heat insulation part. Therefore, a heat pipe according to the present disclosure can exhibit more excellent heat transport properties.

In addition, according to the aspect of the present disclosure, since in a cross-section perpendicular to the longitudinal direction of the container, the uneven part is formed in the surface of the first sintered part, the surface area of the first sintered part increases, and thus an evaporation resistance of the working fluid in the liquid phase is reduced, and as a result, it is possible to exhibit more excellent heat transport properties.

In addition, according to the aspect of the present disclosure, since the average thickness of the first sintered part is smaller than the average thickness of the second sintered part, a liquid membrane of the working fluid in the liquid phase in the evaporation part can be made to be thin, and thus, the evaporation resistance of the working fluid in the liquid phase is reduced, and as a result, it is possible to exhibit more excellent heat transport properties.

DETAILED DESCRIPTION

Embodiments

Figures 1A, 1B, 1C:
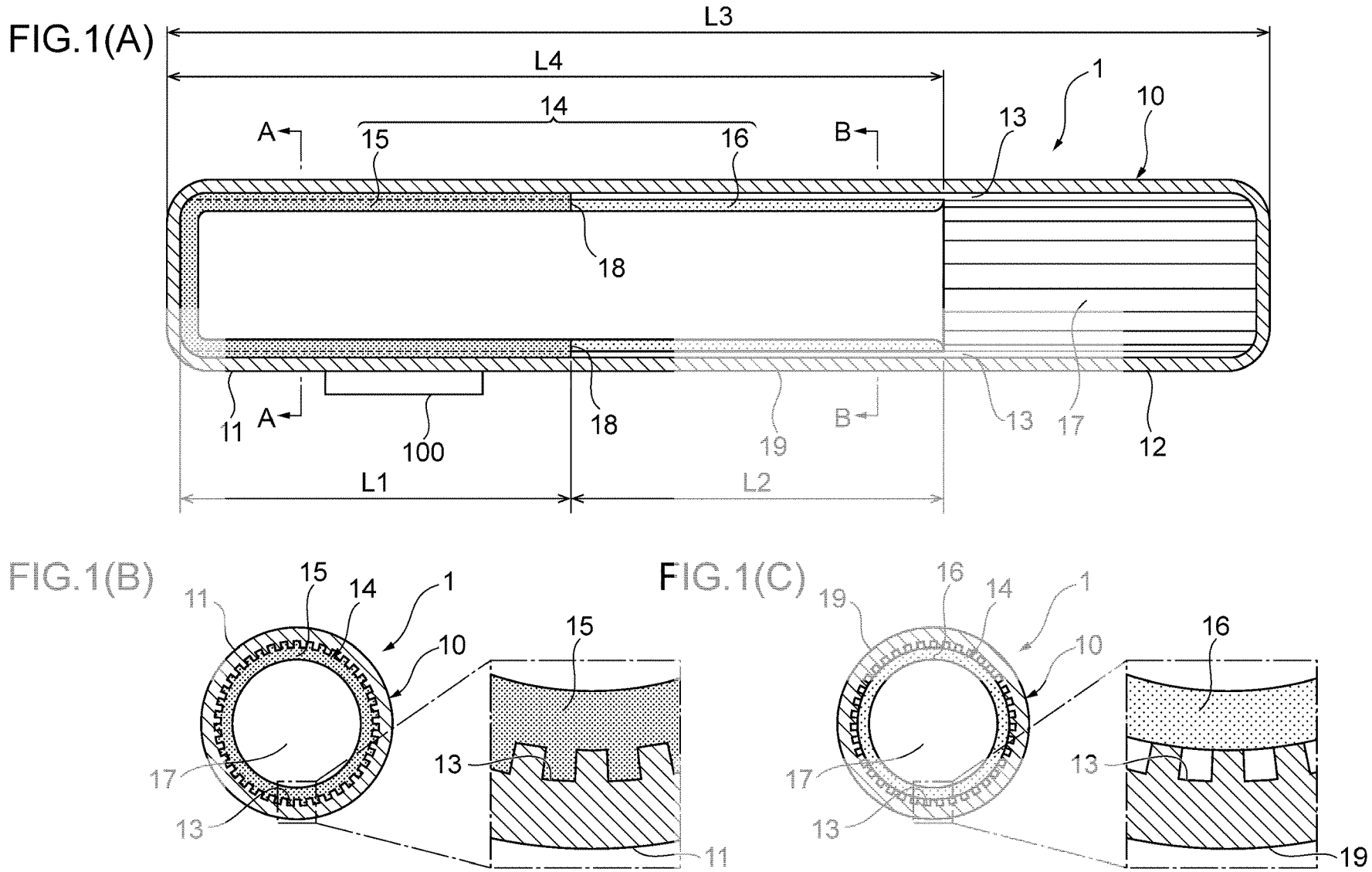
FIG. 1A is a side cross-sectional view illustrating an overview of a heat pipe according to a first embodiment of the present disclosure.
FIG. 1B is a cross-sectional view, taken along arrows A-A in FIG. 1A
FIG. 1C is a cross-sectional view, taken along arrows B-B in FIG. 1A.
Figure 2:
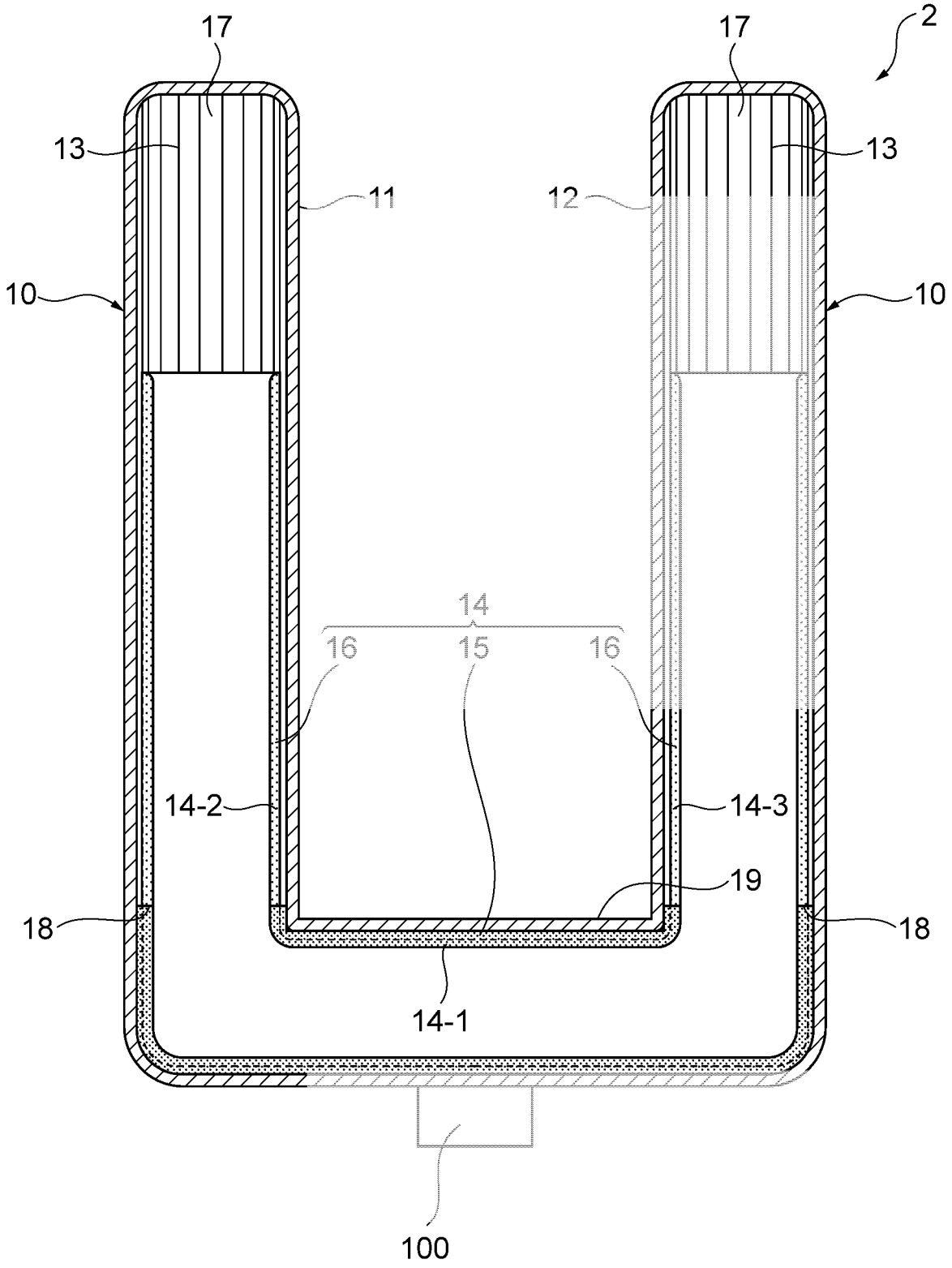
FIG. 2 is a side cross-sectional view illustrating an overview of a heat pipe according to a second embodiment of the present disclosure.
Figure 3:
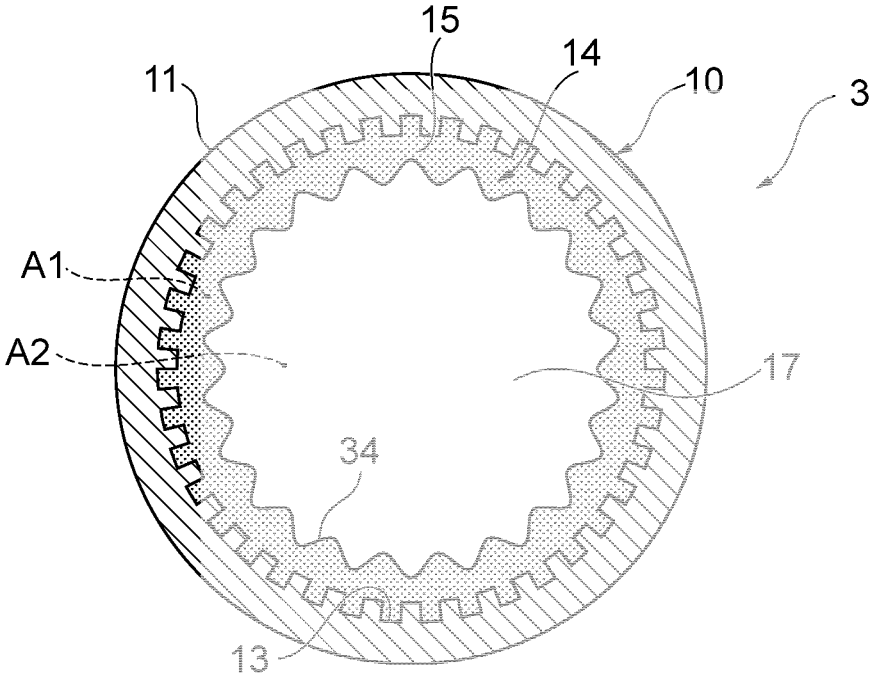
FIG. 3 is a front cross-sectional view illustrating an overview of a heat pipe according to a third embodiment of the present disclosure.
Figure 4:
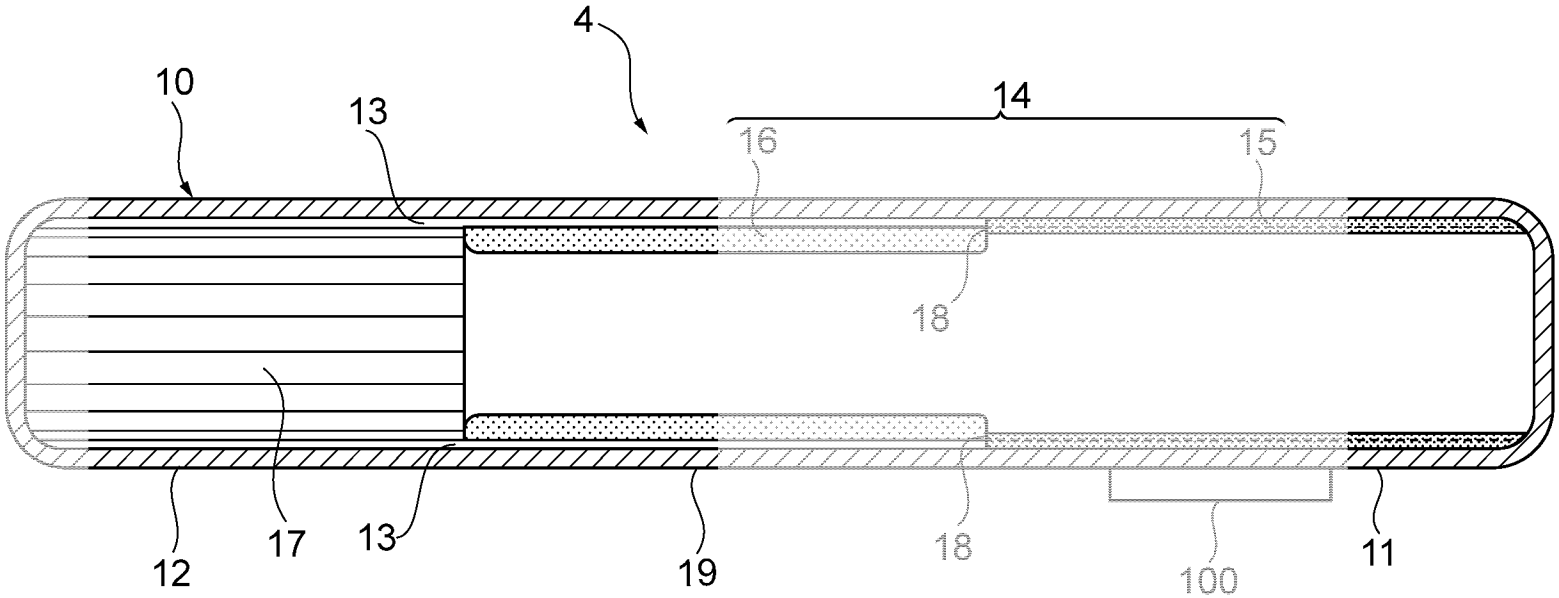
FIG. 4 is a side cross-sectional view illustrating an overview of a heat pipe according to a fourth embodiment of the present disclosure.
Figure 5:
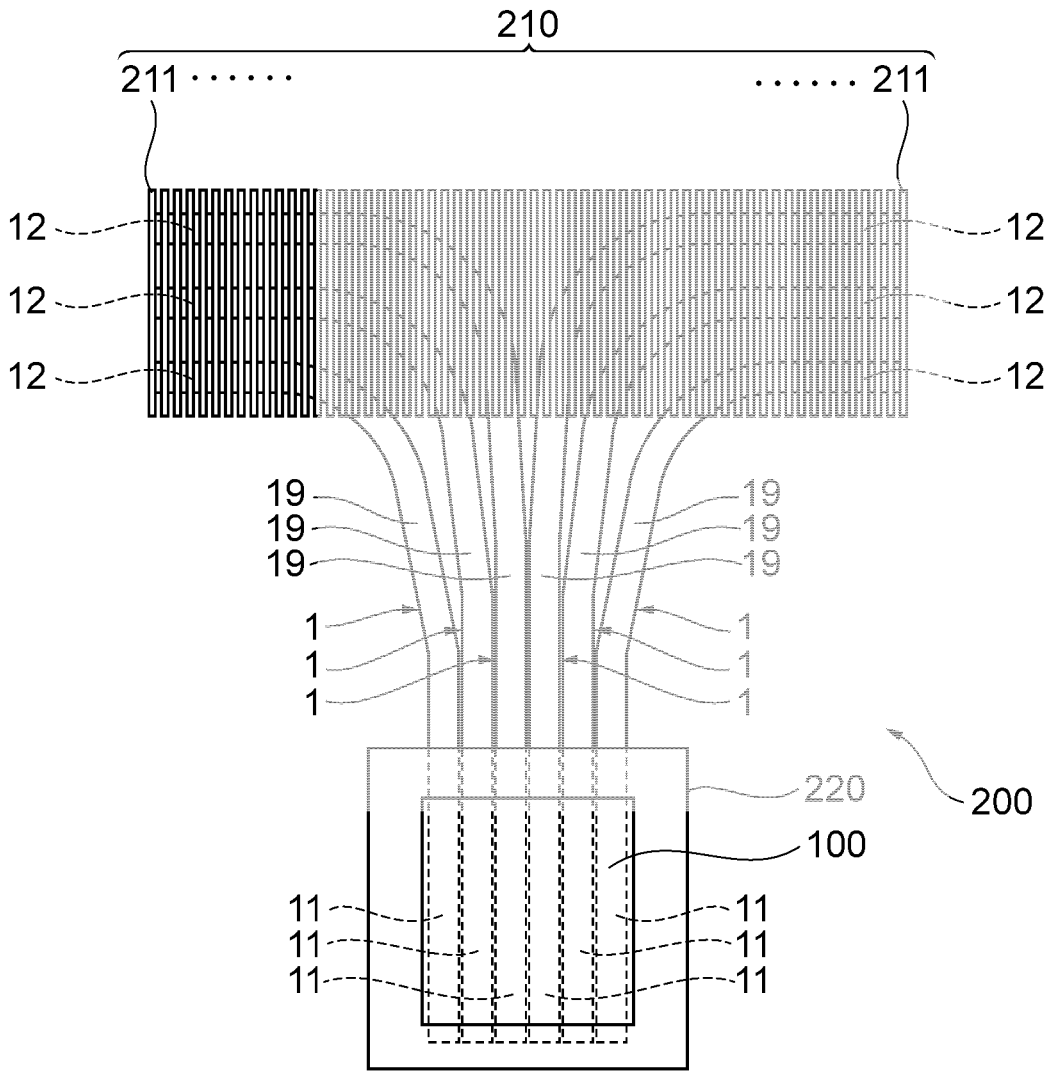
FIG. 5 is a diagram illustrating an example of a usage method of a heat pipe according to an embodiment of the present disclosure.

Hereinafter, heat pipes according to embodiments of the present disclosure will be described. FIG. 1A is a side cross-sectional view illustrating an overview of a heat pipe according to a first embodiment of the present disclosure, FIG. 1B is a cross-sectional view, taken along arrows A-A in FIG. 1A and FIG. 1C is a cross-sectional view, taken along arrows B-B in FIG. 1A. FIG. 2 is a side cross-sectional view illustrating an overview of a heat pipe according to a second embodiment of the present disclosure. FIG. 3 is a front cross-sectional view illustrating an overview of a heat pipe according to a third embodiment of the present disclosure. FIG. 4 is a side cross-sectional view illustrating an overview of a heat pipe according to a fourth embodiment of the present disclosure. FIG. 5 is a diagram illustrating an example of a usage method of a heat pipe according to an embodiment of the present disclosure.

First, the heat pipe according to the first embodiment of the present disclosure will be described with reference to the accompanying drawings. As shown in FIG. 1A, a heat pipe 1 according to the first embodiment includes: a tubular container 10 whose end surfaces of one end part 11 and another end part 12 are sealed; a groove part 13 which is constituted of a plurality of fine grooves formed in an inner wall surface of the container 10 along a longitudinal direction of the container 10; a sintered body layer 14 which is provided on respective inner wall surfaces of the one end part 11 and a central part 19 of the container 10 and is formed by sintering a powder; and a working fluid (not shown) sealed in a hollow part 17 of the container 10.

The container 10 is a sealed-up substantially linear tubing material and a cross-sectional shape of the container 10 in a direction orthogonal to the longitudinal direction (that is, perpendicular to the longitudinal direction) is not particularly limited, and as shown in FIGS. 1B and 1C, is a substantially circular shape in the heat pipe 1. A thickness of the container 10 is not particularly limited and for example, is 0.1 to 0.8 mm. A dimension of the container 10 in a radial direction is not particularly limited and for example, is 5 to 20 mm.

As shown in FIGS. 1A, 1B and 1C, in the inner wall surface of the container 10, the groove part 13 constituted of the plurality of fine grooves, that is, grooves are formed along the longitudinal direction of the container 10 from the one end part 11 to the other end part 12. Therefore, the groove part 13 is formed in the one end part 11, the other end part 12 and the central part 19 between the one end part 11 and the other end part 12. In addition, the groove part 13 is formed in the whole inner peripheral surface of the container 10. The groove part 13 has a necessary capillary force.

The sintered body layer 14 formed by sintering the powder is provided in the one end part 11 and the central part 19 of the inner wall surface of the container 10 where the groove part 13 is formed. The sintered body layer 14 is formed on the whole inner peripheral surface of the container 10. Accordingly, in the inner wall surfaces of the one end part 11 and the central part 19, the groove part 13 is covered by the sintered body layer 14. Note that in the heat pipe 1, no sintered body layer 14 is provided in the other end part 12 of the container 10. Therefore, in the other end part 12 of the container 10, the groove part 13 is exposed to an inside space (hollow part 17) of the container 10.

In addition, the sintered body layer 14 includes a first sintered part 15 provided on the one end part 11, and a second sintered part 16 provided on the central part 19, the second sintered part 16 being continuous with the first sintered part 15. In a border between the first sintered part 15 and the second sintered part 16, a boundary part 18 is formed. Note that in the heat pipe 1, also on the end surface of the one end part 11, the first sintered part 15 is provided.

Also, as shown in FIG. 1A, in the heat pipe 1, a surface of the first sintered part 15 is a substantially flat and smooth and a surface of the second sintered part 16 is also substantially flat and smooth. Also, a thickness of the first sintered part 15 is substantially uniform and a thickness of the second sintered part 16 is also substantially uniform. Furthermore, an average thickness of the first sintered part 15 is substantially equal to an average thickness of the second sintered part 16. Therefore, the boundary part 18 includes no step and is flat.

The first sintered part 15 is a sintered body formed of a first powder and the second sintered part 16 is a sintered body formed of a second powder. A capillary force of the first sintered part 15 is larger than a capillary force of the second sintered part 16. In the heat pipe 1, an average primary particle diameter of the first powder, which is a raw material of the first sintered part 15, is smaller than an average primary particle diameter of the second powder, which is a raw material of the second sintered part 16, and accordingly, the capillary force of the first sintered part 15 is larger than the capillary force of the second sintered part 16. According to the above, the inside of the second sintered part 16 includes more pores (not shown) than the inside of the first sintered part 15, and a porosity of the inside of the second sintered part 16 is larger than a porosity of the inside of the first sintered part 15. Also, a flow path resistance inside the second sintered part 16 against a working fluid in a liquid phase is smaller than a flow path resistance inside the first sintered part 15 against the working fluid in the liquid phase.

According to the above, as shown in FIGS. 1B and 1C, the porosity of the second sintered part 16 in the groove part 13 is larger than the porosity of the first sintered part 15 in the groove part 13. Therefore, the heat pipe 1 has excellent thermal connectivity between the container 10 and the first sintered part 15, whereby heat is smoothly transferred from the container 10 to the first sintered part 15. Also, even though the second sintered part 16 is provided on the inner wall surface of the container 10, the working fluid in the liquid phase can smoothly be refluxed inside the groove part 13 from a condensation part toward an evaporation part.

Note that for convenience of description, in FIG. 1B, the inside of the groove part 13 is filled with the first sintered part 15, and in FIG. 1C, no second sintered part 16 is provided inside the groove part 13.

Also, in the heat pipe 1, the capillary force of the first sintered part 15 is larger than a capillary force of a portion of the groove part 13, the portion being located in one end part 11, and the capillary force of the second sintered part 16 is larger than a capillary force of a portion of the groove part 13, the portion being located in the central part 19. In the one end part 11, the first sintered part 15 is formed directly on the groove part 13, and the surface of the first sintered part 15 is exposed to the inside space (hollow part 17) of the container 10. In the central part 19, the second sintered part 16 is formed directly on the groove part 13 and the surface of the second sintered part 16 is exposed to the inside space (hollow part 17) of the container 10. Therefore, no additional wick structure is provided on the sintered body layer 14.

A ratio of the average primary particle diameter of the second powder to the average primary particle diameter of the first powder is not particularly limited, and in consideration of a balance between reduction in the capillary force inside the first sintered part 15 and the flow path resistance inside the second sintered part 16, it is preferable that the ratio be 1.3 to 2.0, and it is particularly preferable that the ratio be 1.4 to 1.7. In addition, the average primary particle diameter of the first powder and the average primary particle diameter of the second powder are not particularly limited as long as the average primary particle diameter of the first powder is smaller than the average primary particle diameter of the second powder. For example, it is preferable that the average primary particle diameter of the first powder be equal to or greater than 50 μm and equal to or less than 100 μm, and it is preferable that the average primary particle diameter of the second powder be equal to or greater than 80 μm and equal to or less than 150 μm. For each of the first powder and the second powder, the powder in the average primary particle diameter range can be obtained by, for example, sieving the powder.

As shown in FIGS. 1A, 1B and 1C, the inside space of the container 10 is the hollow part 17 and the hollow part 17 functions as a steam flow path for the working fluid in a gas phase. In other words, a surface of the sintered body layer 14 in the one end part 11 and the central part 19 of the container 10 and the inner wall surface of the container 10 with the groove part 13 formed therein in the other end part 12 of the container 10 constitute a wall surface of the steam flow path. In addition, the hollow part 17 extends along a heat transport direction in the heat pipe 1.

A value of a length (L1) of the first sintered part 15 divided by a length (L2) of the second sintered part 16 in the longitudinal direction of the container 10 can appropriately be selected according to, e.g., conditions of use of the heat pipe and is not particularly limited, but, for example, it is preferable that the value be 0.2 to 3.0, and it is particularly preferable that the value be 0.7 to 1.7. In addition, a value of a length (L3) of the container 10 divided by a length (L4) of the sintered body layer 14 in the longitudinal direction of the container 10 can appropriately be selected according to, e.g., conditions of use of the heat pipe and is not particularly limited, but, for example, it is preferable that the value be 1.3 to 1.8, and it is particularly preferable that the value be 1.4 to 1.6.

A material of the container 10 is not particularly limited and for example, in light of excellent heat conductivity, copper, a copper alloy, and the like, in light of a lightweight property, aluminum, an aluminum alloy, and the like, and in light of enhancement in mechanical strength, a metal such as stainless steel and the like can be cited. Furthermore, in accordance with a situation of use of the heat pipe 1, tin, a tin alloy, titanium, a titanium alloy, nickel, a nickel alloy, and the like can be used. Materials of the first powder and the second powder, which are raw materials of the sintered body layer 14, are not particularly limited and for example, a powder including a metallic powder can be cited, and as a specific example, a metallic powder such as a copper powder and a stainless-steel powder, a mixed powder of a copper powder and a carbon powder, nanoparticles of the above-mentioned powders, and the like can be cited. Accordingly, as the sintered body layer 14, a sintered body of the powder including the metallic powder can be cited, and as a specific example, a sintered body of the metallic powder such as the copper powder and the stainless-steel powder, a sintered body of the mixed powder of the copper powder and the carbon powder, a sintered body of the nanoparticles of the above-mentioned powders, and the like can be cited. The material of the first powder and the material of the second powder may be the same or may be different from each other.

If the first sintered part 15 and the second sintered part 16 are formed of a same kind of material, for example, a sintered body of a metallic powder, it is possible to provide an excellent force of bonding between the first sintered part 15 and the second sintered part 16, enhancing the mechanical strength of the sintered body layer 14. In addition, as a result of the first sintered part and the second sintered part being formed of a same kind of material (for example, a sintered body of a metallic powder), efficiency of manufacture of the sintered body layer 14 is enhanced.

Also, the working fluid sealed in the container 10 can appropriately be selected according to the material of the container 10, and for example, water, an alternative for chlorofluorocarbon, perfluorocarbon, cyclopentane, and the like can be cited. As described above, the heat pipe 1 does not require use of a non-freezing solution as a working fluid and thus can exhibit excellent heat transport properties.

Next, a mechanism of heat transport of the heat pipe 1 according to the first embodiment of the present disclosure will be described. In the heat pipe 1, upon a heating element 100 being thermally connected to the one end part 11 in which the first sintered part 15 is provided, the one end part 11 functions as an evaporation part (heat receiving part), and upon a heat exchanger (not shown) being thermally connected to the other end part 12 in which no sintered body layer 14 is provided, the other end part 12 functions as a condensation part (heat dissipation part). Also, the central part 19 in which the second sintered part 16 is provided functions as a heat insulation part. When the evaporation part of the heat pipe 1 receives heat from the heating element 100, the working fluid phase-changes from the liquid phase to the gas phase. The working fluid that has phase-changed to the gas phase flows through the steam flow path, which is the hollow part 17, from the evaporation part to the condensation part (other end part 12 in the heat pipe 1) in the longitudinal direction of the container 10, and the heat from the heating element 100 is thereby transported from the evaporation part to the condensation part. Through phase-changing of the working fluid in the gas phase to the liquid phase, the heat from the heating element 100, which has been transported from the evaporation part to the condensation part, is released as latent heat at the condensation part provided with the heat exchanger. The latent heat released in the condensation part is released by the heat exchanger provided for the condensation part from the condensation part to an environment outside the heat pipe 1. The working fluid that has phase-changed to the liquid phase in the condensation part is refluxed from the condensation part to the heat insulation part by the capillary force of the groove part 13 and is refluxed from the heat insulation part to the evaporation part by the capillary force of the groove part 13 and the capillary force of the second sintered part 16.

Since in the heat pipe 1 according to the first embodiment, the flow path resistance inside the second sintered part 16 located in the heat insulation part (central part 19 in the heat pipe 1) is smaller than the flow path resistance inside the first sintered part 15 located in the evaporation part (one end part 11 in the heat pipe 1), the working fluid in the liquid phase can smoothly be refluxed from the condensation part to the evaporation part via the heat insulation part. In addition, since in the heat insulation part, not only the capillary force of the groove part 13 in the inner wall surface of the container 10 but also the capillary force of the second sintered part 16 are generated and the capillary force of the second sintered part 16 is larger than the capillary force of the portion of the groove part 13, the portion being located in the heat insulation part, the reflux of the working fluid in the liquid phase from the condensation part toward the evaporation part can reliably be prevented from being hindered by the working fluid in the gas phase, which flows from the evaporation part toward the condensation part. Furthermore, since the capillary force of the first sintered part 15 located in the evaporation part is larger than the capillary force of the second sintered part 16 located in the heat insulation part, the working fluid in the liquid phase that has been refluxed to the evaporation part can smoothly be diffused inside the first sintered part 15. As a result of the smooth diffusion inside the first sintered part 15, it is possible to reduce a thickness of a liquid membrane of the working fluid in the liquid phase in the evaporation part, enabling reduction of an evaporation resistance of the working fluid in the liquid phase and also enabling preventing the working fluid in the liquid phase in the evaporation part from drying out. According to various effects described above, the heat pipe 1 has excellent heat transport properties. Therefore, even under tougher use conditions such as a situation in which an amount of heat generation by an electronic component that is an object to be cooled by the container 10 further increases, the heat pipe 1 can exhibit excellent heat transport properties.

Furthermore, in the heat pipe 1 according to the first embodiment, when the heat pipe 1 is not in operation, the working fluid in the liquid phase that has been refluxed to the first sintered part 15 smoothly diffuses inside the first sintered part 15 without locally liquid-pooling in the first sintered part 15. Therefore, even when the heat pipe 1 is not in operation, the working fluid in the liquid phase can be prevented from locally liquid-pooling in the evaporation part of the container 10, and thus, even in a cold use environment, freezing of the working fluid in the liquid phase is inhibited. Accordingly, the heat pipe 1 can exhibit excellent heat transport properties even under tougher use conditions such as the heat pipe 1 being installed in a cold environment. Also, even if the working fluid in the liquid phase freezes, since the working fluid in the liquid phase is prevented from locally liquid-pooling, local expansion in volume of the working fluid is alleviated, enabling prevention of deformation of the container 10. Therefore, there is no need to use a thick container 10, and thus, thermal conductivity from the heating element 100 to the first sintered part 15 is enhanced, enabling exhibiting excellent heat transport properties.

Also, in the heat pipe 1 according to the first embodiment, the porosity of the second sintered part 16 inside the portion of the groove part 13, the portion being located in the heat insulation part is larger than the porosity of the first sintered part 15 inside the portion of the groove part 13, the portion being located in the evaporation part, and thus the heat pipe 1 also exhibits the effect of enhancing thermal conductivity between the container 10 and the first sintered part 15 in the evaporation part while the working fluid in the liquid phase can be more smoothly refluxed inside the second sintered part 16 from the condensation part toward the evaporation part.

Next, a heat pipe according to a second embodiment of the present disclosure will be described with reference to the drawing. Note that since a major configuration of the heat pipe according to the second embodiment is the same as that of the above-described heat pipe according to the first embodiment, components that are the same as those of the above-described heat pipe according to the first embodiment will be described using signs that are the same as those of the above-described heat pipe.

While in the heat pipe 1 according to the first embodiment, the sintered body layer 14 is provided in the one end part 11 and the central part 19 of the inner wall surface of the container 10, instead, as shown in FIG. 2, in a heat pipe 2 according to the second embodiment, a sintered body layer 14 is provided in a central part 19 in a longitudinal direction of a container 10 and no sintered body layer 14 is provided in one end part 11 and another end part 12 in the longitudinal direction of the container 10. Also, a first sintered part 15 of the sintered body layer 14 is provided in a center 14-1 in a longitudinal direction of the sintered body layer 14 and a total of two second sintered parts 16 that are continuous with the first sintered part 15 are provided: one second sintered part 16 is provided for each of one end 14-2 and another end 14-3 in the longitudinal direction of the sintered body layer 14.

Although in the heat pipe 2, the shape in the longitudinal direction of the container 10 is not particularly limited and for example, a linear shape or a shape including a curved part, in the heat pipe 2, a shape in the longitudinal direction of the container 10 is a substantially U-shape and the sintered body layer 14 is provided in a curved part and the vicinity of the curved part. In the heat pipe 2, a heating element 100 is thermally connected to a portion of the central part 19 in the longitudinal direction of the container 10, the portion corresponding to the first sintered part 15, and the portion corresponding to the first sintered part 15 thereby serves as an evaporation part. Also, a heat exchanger (not shown) is thermally connected to each of the one end part 11 and the other end part 12 in the longitudinal direction of the container 10 and the one end part 11 and the other end part 12 thereby each serve as a condensation part. Portions of the central part 19 in the longitudinal direction of the container 10, the portions corresponding to the respective second sintered parts 16, each serve as a heat insulation part. Even the heat pipe 2 with the sintered body layer 14 provided in the central part 19 in the longitudinal direction of the container 10 exhibits effects that are similar to the above.

Next, a heat pipe according to a third embodiment of the present disclosure will be described with reference to the drawing. Note that since a major configuration of the heat pipe according to the third embodiment is the same as those of the above-described heat pipes according to the first and second embodiments, components that are the same as those of the above-described heat pipes according to the first and second embodiments will be described using signs that are the same as those of the heat pipes.

While in the heat pipe 1 according to the first embodiment, the surface of the first sintered part 15 is substantially flat and smooth and the surface of the second sintered part 16 is also substantially flat and smooth, instead, as shown in FIG. 3, in a heat pipe 3 according to the third embodiment, an uneven part 34 is formed at a surface of a sintered body layer 14. In the heat pipe 3, the uneven part 34 is formed at least at a surface of a first sintered part 15. The uneven part 34 may be formed in the entire surface of the first sintered part 15 or may be formed in only a partial region of the surface of the first sintered part 15. In FIG. 3, the uneven part 34 is formed in the entirety in a circumferential direction of the first sintered part 15. Note that as necessary, the uneven part 34 may be formed also in a surface of a second sintered part (not shown in FIG. 3).

In the heat pipe 3, a shape of the uneven part 34 is a wave shape in which a recessed part and a protruding part are repeated along the circumferential direction of a container 10.

In the heat pipe 3, the uneven part 34 is formed at the surface of the first sintered part 15, which causes an increase in surface area of the first sintered part 15, and thus causes an increase in area for evaporation of a working fluid in a liquid phase and consequently causes reduction in evaporation resistance of the working fluid in the liquid phase, and as a result, the heat pipe 3 can exhibit more excellent heat transport properties.

Next, a heat pipe according to a fourth embodiment of the present disclosure will be described with reference to the drawing. Note that since a major configuration of the heat pipe according to the fourth embodiment is the same as those of the above-described heat pipes according to the first to third embodiments, components that are the same as those of the above-described heat pipes according to the first to third embodiments will be described using signs that are the same as those of the heat pipes.

While in the heat pipe 1 according to the first embodiment, the thickness of the first sintered part 15 and the thickness of the second sintered part 16 are substantially the same and no step is formed in the boundary part 18, instead, as shown in FIG. 4, in a heat pipe 4 according to the fourth embodiment, a thickness of a first sintered part 15 is smaller than a thickness of a second sintered part 16. Therefore, a step is formed in a boundary part 18.

As a result of the thickness of the first sintered part 15 being smaller than the thickness of the second sintered part 16, a liquid membrane of a working fluid in a liquid phase in an evaporation part located in one end part 11 can be made to be thinner, and thus, an evaporation resistance of the working fluid in the liquid phase is reduced, and as a result, it is possible to exhibit more excellent heat transport properties.

Next, an example of a method for manufacturing a heat pipe according to the present disclosure will be described. Here, the description will be provided taking the heat pipe 1 according to the first embodiment as an example. The manufacturing method is not particularly limited, and for example, in the case of the heat pipe 1 according to the first embodiment, a core rod having a predetermined shape is inserted to a portion from one end part to a central part in a longitudinal direction of a circular tubing material with a groove part 13 formed in an inner wall surface thereof. A predetermined amount of a first powder, which is a raw material of a first sintered part 15, and a predetermined amount of a second powder, which is a raw material of a second sintered part 16, are sequentially charged from another end part of the tubing material into a gap portion formed between the inner wall surface of the tubing material and an outer surface of the core rod. Next, the tubing material charged with the first powder and the second powder is heated and the core rod is removed from the tubing material, enabling manufacture of the heat pipe 1 including the first sintered part 15 in the one end part 11 and the second sintered part 16 in the central part 19.

Note that the heat pipe 3 according to the third embodiment in which the uneven part 34 is formed in the first sintered part 15 can be manufactured by inserting a core rod including a predetermined cutout portion corresponding to the uneven part 34 to a tubing material, charging a first powder, which is a raw material of a first sintered part, into not only a gap portion formed between an inner wall surface of the tubing material and an outer surface of the core rod but also a gap portion formed between the inner wall surface of the tubing material and the cutout portion and then heating the resulting tubing material.

Next, an example of a usage method of a heat pipe according to the present disclosure will be described. A heat pipe according to the present disclosure can be used for a heat sink. For example, as shown in a heat sink 200 in FIG. 5, a plurality of one end parts 11 of the heat pipes 1 according to the first embodiment are disposed in parallel to form a heat pipe group. Note that in each of the heat pipes 1 according to the first embodiment, instead of a container having a substantially linear shape in a longitudinal direction thereof, a container having a shape including a curved part in a longitudinal direction thereof (substantially L-shape in FIG. 5) is used. Furthermore, other end parts 12 of the heat pipes 1 disposed in a left half of the heat pipe group extend leftward and other end parts 12 of the heat pipes 1 disposed in a right half of the heat pipe group extend rightward.

In the heat pipes 1, the other end parts 12 with no sintered body layer are provided with a heat dissipation fin group 210 in which a plurality of heat dissipation fins 211 are disposed in parallel along a longitudinal direction of the other end parts 12, to cause the other end parts 12 to function as a condensation part. Furthermore, in the heat pipes 1, a heating element 100 is thermally connected to the one end parts 11 provided with the first sintered part, via a heat receiving plate 220 to cause the one end parts 11 to function as an evaporation part. On the other hand, neither heat dissipation fin group 210 nor heat receiving plate 220 is thermally connected to central parts 19 of the heat pipes 1 to cause the central parts 19 to function as a heat insulation part. In such a manner as described above, the heat pipes 1 can be used for the heat sink 200 in which the one end parts 11 function as an evaporation part and the other end parts 12 function as a condensation part.

Next, a heat pipe according to another embodiment of the present disclosure will be described. Although in each of the above-described embodiments, a cross-sectional shape of the container in a direction orthogonal to the longitudinal direction is a substantially circular shape, the shape is not particularly limited, and for example, may be an elliptical shape or a flattened shape.

Also, although in the heat pipe according to the first embodiment, the thickness of the first sintered part and the thickness of the second sintered part are substantially the same and in the heat pipe according to the fourth embodiment, the thickness of the first sintered part is smaller than the thickness of the second sintered part, instead, a thickness of a first sintered part may be larger than a thickness of a second sintered part. As a result of the thickness of the first sintered part being larger than the thickness of the second sintered part, a capillary force of the first sintered part becomes significantly larger than a capillary force of the second sintered part. Therefore, even if an amount and density of heat generation by a heating element, which is an object to be cooled by the heat pipe, are extremely large, it is possible to reliably prevent a working fluid in a liquid phase in an evaporation part from drying out and exhibit excellent heat transport properties.

A heat pipe according to the present disclosure enables a working fluid in a liquid phase to be smoothly refluxed through a heat insulation part and enables preventing the reflux of the working fluid in the liquid phase from being hindered by a flow of the working fluid in a gas phase and thus can exhibit excellent heat transport properties. Therefore, a heat pipe according to the present disclosure is highly useful in a field in which the heat pipe is used under tougher conditions such as a situation in which an amount of heat generation by electronic components further increases.

What is claimed is:

1. A heat pipe comprising:

a container having a tubular shape in which an end surface of one end part and an end surface of another end part are sealed, the container including an inner wall surface in which a groove part is formed;

a sintered body layer provided on the inner wall surface of the container, the sintered body layer being formed by sintering a powder; and a working fluid sealed in a hollow part of the container, wherein:

the sintered body layer includes a first sintered part located in an evaporation part of the heat pipe, and a second sintered part located in a heat insulation part between the evaporation part and a condensation part of the heat pipe, the second sintered part being continuous with the first sintered part, a capillary force of the first sintered part is larger than a capillary force of the second sintered part, in a longitudinal direction of the container, a length of the sintered body layer is larger than a length of a portion in which the groove part is exposed to an inside space of the container and a value of a length of the first sintered part divided by a length of the second sintered part is 0.2 to 3.0 and a value of a length of the container divided by a length of the sintered body layer in the longitudinal direction of the container is 1.3 to 1.8;

a porosity of the second sintered part in a portion of the groove part, the portion being located in the heat insulation part is larger than a porosity of the first sintered part in a portion of the groove part, the portion being located in the evaporation part, in the heat insulation part, the second sintered part has the porosity so that both the capillary force of the groove part and the capillary force of the second sintered part work in the groove part, and the working fluid in a liquid phase is refluxed inside the groove part from the condensation part toward the evaporation part, and a portion in which the first sintered part is provided receives heat from a heating element and a portion in which the second sintered part is provided receives no heat from the heating element.

2. The heat pipe according to claim 1, wherein the sintered body layer is provided in the one end part and a central part in the longitudinal direction of the container and is not provided in the other end part.

3. The heat pipe according to claim 1, wherein the sintered body layer is provided in a central part in the longitudinal direction of the container and is not provided in the one end part and the other end part.

4. The heat pipe according to claim 1, wherein the sintered body layer is not provided in the condensation part and the groove part is exposed in the condensation part.

5. The heat pipe according to claim 1, wherein the sintered body layer is a sintered body of a metallic powder.

6. The heat pipe according to claim 4, wherein an average primary particle diameter of a first metallic powder that is a raw material of the first sintered part is smaller than an average primary particle diameter of a second metallic powder that is a raw material of the second sintered part.

7. The heat pipe according to claim 1, wherein the capillary force of the first sintered part is larger than the capillary force of a portion of the groove part, the portion being located in the evaporation part.

8. The heat pipe according to claim 1, wherein the capillary force of the second sintered part is larger than the capillary force of a portion of the groove part, the portion being located in the heat insulation part.

9. The heat pipe according to claim 1, wherein in a cross-section perpendicular to the longitudinal direction of the container, an uneven part is formed in a surface of the first sintered part.

10. The heat pipe according to claim 1, wherein an average thickness of the first sintered part is smaller than an average thickness of the second sintered part.

11. The heat pipe according to claim 1, wherein an average thickness of the first sintered part is larger than an average thickness of the second sintered part.

12. The heat pipe according to claim 6, wherein a ratio of the average primary particle diameter of the second metallic powder to the average primary particle diameter of the first metallic powder is 1.3 to 2.0.

* * * * *